United States Patent [19]

Van Bokestal et al.

[11] 4,151,401

[45] Apr. 24, 1979

[54] PTC HEATING DEVICE HAVING SELECTIVELY VARIABLE TEMPERATURE LEVELS

[75] Inventors: André M. A. Van Bokestal; Charles J. G. Belhomme, both of Brussels, Belgium

[73] Assignee: U.S. Philips Corporation, New York, N.Y.

[21] Appl. No.: 785,968

[22] Filed: Apr. 8, 1977

[30] Foreign Application Priority Data

Apr. 15, 1976 [NL] Netherlands ..... 7603997

[51] Int. Cl.[2] ..... H05B 1/12; H05B 3/24; H01C 1/14; H01C 7/02

[52] U.S. Cl. ..... 219/508; 19/222; 219/241; 219/446; 219/486; 219/505; 338/22 R; 338/201; 338/325

[58] Field of Search ..... 219/222, 225, 241, 505, 219/507, 506, 508, 209, 210, 445, 446, 484–487, 537, 539, 541, 543, 548, 559, 528, 552; 338/22 R, 23, 24, 25, 28, 200, 201, 295, 185, 188, 194, 323, 325, 328

[56] References Cited

U.S. PATENT DOCUMENTS

| | | | |
|---|---|---|---|
| 1,832,532 | 11/1931 | Church | 219/486 |
| 2,075,733 | 3/1937 | Lazarus | 338/24 X |
| 2,392,712 | 1/1946 | Woodman | 219/508 X |
| 2,590,944 | 4/1952 | Cowdrey et al. | 219/543 X |
| 2,966,646 | 12/1960 | Baasch | 338/22 R |
| 3,400,250 | 9/1968 | Buiting et al. | 219/505 X |
| 3,430,336 | 3/1969 | Riddel | 338/22 R |
| 3,477,055 | 11/1969 | Herbst et al. | 338/22 R |
| 3,691,503 | 9/1972 | Battle et al. | 338/201 X |
| 3,763,350 | 10/1973 | Hager | 219/543 X |
| 3,845,442 | 10/1974 | Ihaya et al. | 338/23 |
| 3,858,144 | 12/1974 | Bedard et al. | 219/505 |
| 3,953,711 | 4/1976 | Eck et al. | 338/22 R |
| 4,031,499 | 6/1977 | Brueckner | 338/22 R |

*Primary Examiner*—A. Bartis

*Attorney, Agent, or Firm*—Thomas A. Briody; Bernard Franzblau

[57] ABSTRACT

A controllable electric heating device uses a PTC resistance body having first areal electrode on one surface and two spaced apart areal electrodes of different areal size on the opposite surface in overlapping relation with a part of the first electrode to provide at least two current paths through the resistance body between the opposite surfaces. The first electrode is connected to one terminal of a voltage source. A switching device selectively connects one or more of the two spaced apart electrodes to the other terminal of the voltage source so that the effective electrode areas are altered thereby adjusting the current flow in the PTC body to produce different temperature levels of the heating device.

6 Claims, 3 Drawing Figures

PTC HEATING DEVICE HAVING SELECTIVELY VARIABLE TEMPERATURE LEVELS

Figure 1:
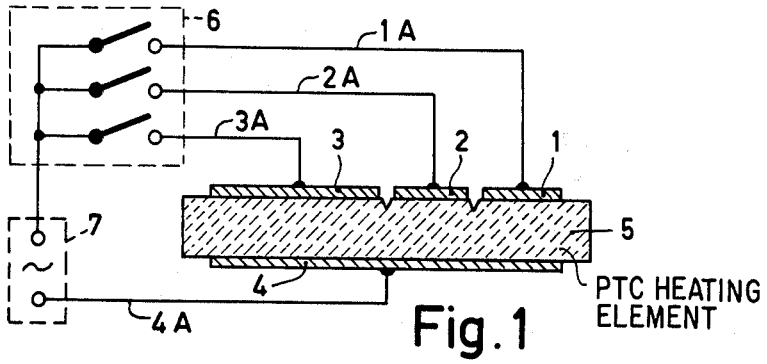

The invention relates to a heating device comprising a resistance body made of a material having a positive temperature coefficient of resistance and provided with electrodes and means to connect these electrodes to an electric voltage source.

Devices of this kind are known per se. They have the advantage that the device stabilizes itself at a given temperature. Above this temperature the resistance of the resistance material strongly increases decreases and, consequently, so does the production of heat.

It is an object of the invention to provide, while using a resistance body made of a material having a positive temperature coefficient of resistance and intricate circuits and avoiding the use of active or passive components such as diodes and resistors, a step-wise controllable electric heating device.

This object, according to the invention, is fulfilled by means of a heating device which is characterized in that the resistance body is provided with at least three electrodes whereof at least one electrode can be connected to one pole of a voltage source and whereof, depending on the temperature level to be reached, one of the other electrodes or a combination thereof can be connected to the other pole of the voltage source by means of a switching device associated with the heating device.

The invention is based on the recognition that it is possible to stabilize the heating device at different temperature levels by controlling the power output in a stepwise manner. It has appeared that when applying a given electric voltage to the device the output power of the resistance body also depends on the ratio between the effective (i.e. surface) areas of the electrodes which are connected to one pole and to the other pole of the voltage source.

In a preferred embodiment of the heating device according to the invention the resistance body comprises two opposite boundary surfaces, one of the boundary surfaces being provided with at least one electrode and the other boundary surface with at least two electrodes which are separated from one another. The resistance body may, for example, consist of a rectangular, square or disc-shaped plate made of a material having a positive temperature coefficient of resistance or also of a hollow cylinder of such a material. In the latter case the inner and the outer surface form the opposite boundary surfaces of the resistance body to which the electrodes are applied.

The resistance material having a positive temperature coefficient to resistance, also indicated as a P.T.C. material hereinafter, may, for example, consist of doped barium titanate, barium lead titanate, barium strontium titanate, whereas the doping may, for example, consist of a rare earth metal, antimony, yttrium or niobium. Such materials are commercially available and extensively described in the relevant literature. The electrodes which must preferably form an ohmic contact may, for example, consist of a coating of a metal or of an alloy such as silver, nickel, or a nickel chromium alloy. These coatings may be obtained, for example, by spraying or screen printing of a paste followed by a thermal treatment, by vapour deposition or by means of processing in an electroless metal bath.

It should be noted that bodies of a P.T.C. material having on one boundary surface an electrode which covers the entire, or substantially the entire, boundary surface and two separate electrodes of mutually equal surfaces which cover the opposite boundary surface, respectively, are described in U.S. Pat. No. 4,031,499 for use in a degaussing circuit for cathode-ray tubes for colour television. In that case the resistance body is used as a switching element for a degaussing coil. In the relevant circuit the two electrodes situated on a boundary surface are connected via the resistance body in series between a pole of the voltage source and a pole of the degaussing coil. The single electrode situated on the other boundary surface is connected across an ohmic resistor in parallel with the other pole of the degaussing coil to the other pole of the voltage source. In that circuit a heating device which is stabilizable at different temperatures is out of the question.

In its simplest form a heating device according to the invention comprises a plate-shaped resistance body which is provided on opposite boundary surfaces with a single metal coating which covers the entire surface, the coating on one surface being separated by means of a sawcut into at least two separate electrodes with mutually different surface areas. It is of course also possible to apply or etch electrodes according to given patterns by means of known photographic techniques.

By means of a switching device the mutually separated electrodes are connected to a pole of a voltage source. In its simplest form the switching device comprises three switching positions by means of which the one or the other electrode or both electrodes can be connected in parallel with the voltage source. The electrodes situated on the other boundary surface may be connected directly to the other pole of the voltage source.

With this simple heating device heat can be dissipated at three different temperature levels. The lowest temperature level is obtained when the electrode having the smallest surface, the next higher when the electrode with the largest surface and the highest level when both electrodes are connected to one pole of the voltage source.

It is immediately clear that a boundary surface can also bear more than two electrodes and that the counter electrodes on the other boundary surface need not consist of a single electrode but also may consist of two or more separate electrodes. In this manner the number of temperature levels can be extended as required. Heating devices according to the invention can be utilized everywhere where there is a need for controlling the temperature in a step-wise manner, such as in haircurlers, irons, boiling plates, soldering irons, etc.

Figure 2:
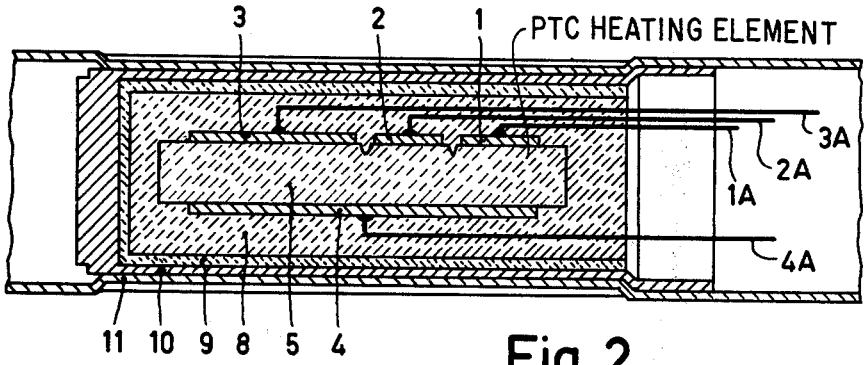
Figure 3:
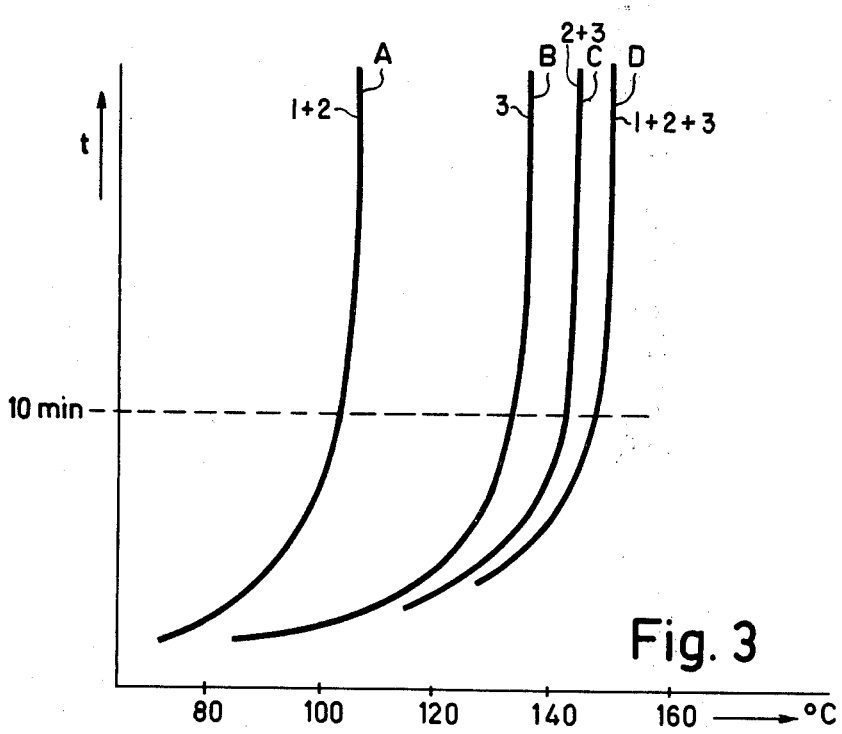

An embodiment of the invention will be further explained with reference to the accompanying drawing, in which:

FIG. 1 shows diagrammatically a heating device having a resistance body with three electrodes and a counter electrode, FIG. 2 shows a cross-section of the resistance body incorporated in the curling tube of hair curling tongs and FIG. 3 is a graph in which the temperature variation versus time is shown with different temperature levels measured at the outside of the curling tube. On a resistance body 5 of doped barium lead titanate ($Ba_{0.747}Pb_{0.25}La_{0.003}TiO_3$) having a curie point of approximately 200° C. and the dimensions $3.5\times0.7\times0.5$ cm, electrodes 1, 2, 3 and 4 of nickel chromium are applied on the two opposite boundary surfaces with a layer thickness of 0.3 micrometers. The electrodes have an effective area of: electrode 1=0.4 $cm^2$, electrode 2=0.4 $cm^2$, electrode 3=1.1 $cm^2$and electrode 4=2.2 $cm^2$ respectively. By means of the switching device 6 (shown diagtammatically) the electrodes 1, 2,3 can be connected in different combinations and separately to the voltage source 7.

FIG. 2 shows a cross-section of the resistance body of FIG. 1 provided with an envelope and accommodated in the curling tube of a pair of hair curling tongs (not shown in the drawing). The resistance body 5, provided with electrodes 1, 2, 3 and 4 and the current conductors 1A, 2A, 3A and 4A, is disposed in a tube 9 consisting of a mixture of 30 weight % of silicone rubber and 70 weight % of magnesium powder, which, after pressing, is vulcanized. The resistance body 5 is embedded in a mass 8 consisting of 30 weight % of silicone rubber and 70 weight % of magnesium oxide which is vulcanized after application of the mass. The assembly is disposed in an envelope 10 of aluminium having a wall thickness of 0.7 mm and is located in the so-called curling tube 11, also made of aluminium, of a pair of curling tongs. The wall of this curling tube is 0.8 mm thick and there is an airgap of 1 mm between the two tubes.

In this embodiment the outer wall of the curling tube reached, when the resistance was operated from a 220 volt AC supply, in all cases after approximately 10 min., a stable temperature level as shown in the table.

| Curve | Switched on electrodes | Current in mA | Power output in W | reached temp. ° C. |
|---|---|---|---|---|
| A | (1+2) versus 4 | 50 | 11.0 | 106 |
| B | 3 versus 4 | 66 | 14.52 | 136 |
| C | (2+3) versus 4 | 74 | 16.28 | 144 |
| D | (1+2+3) versus 4 | 82 | 18.04 | 149 |

For these tests the heating device was built into commercially available curling tongs.

What is claimed is:

1. A heating device comprising a resistance body having two opposite boundary surfaces and made of a material having a positive temperature coefficient of resistance and provided with at least three electrodes, one of the boundary surfaces being provided with a first electrode which covers a major part of the surface area of said one boundary surface and the other boundary surface including at least two other electrodes which together cover a major part of the surface area of said other boundary surface thereby to provide at least two parallel current paths in the resistance body between said opposite boundary surfaces, means connecting at least said first electrode of the resistance body to one terminal of a voltage source, and a switching device for selectively connecting one or more of said other electrodes to the other terminal of the voltage source so as to selectively alter the relative effective electrode surface areas so that the heat developed in the resistance body is dependent on the electrodes selectively energized by the switching device.

2. A heating device as claimed in claim 1, and wherein said at least two other electrodes have different effective areas.

3. A heating device comprising a resistance body made of a material having a positive temperature coefficient of resistance and provided with at least three areal electrodes, said resistance body having two opposite boundary surfaces one of which is provided with a first electrode and the other boundary surface including at least two other electrodes having different surface areas thereby to provide at least two parallel current paths in the resistance body between said opposite boundary surfaces, means connecting said first electrode of the resistance body on said one boundary surface to one terminal of a voltage source, and a switching device for selectively connecting one or more of the at least two other electrodes on the other boundary surface to the other terminal of the voltage source depending on the temperature level to be reached.

4. A multilevel heating device comprising, a resistance body of a given thickness and having first and second opposite surfaces and made of a temperature sensitive material having a positive temperature coeficcient of resistance, a first areal electrode secured to the first surface of said body, at least two other areal electrodes secured to the second surface of the body in spaced apart relationship to each other and each in overlapping relation with a part of said first electrode to provide at least two parallel electrical conduction paths through the resistance body between said opposite surfaces, means connecting said first electrode to one terminal of a voltage source, and means for adjusting the temperature level of the device comprising a switching device for selectively connecting one or more of said other electrodes to the other terminal of the voltage source thereby to selectively alter the effective electrode surface areas so as to vary the current through the resistance body and thus the degree of heating thereof in accordance with the desired temperature level of the heating device selected by the switching device.

5. A multilevel heating device comprising, a resistance body having first and second opposite surfaces and made of a temperature sensitive material having a positive temperature coefficient of resistance, a first areal electrode secured to the first surface of said body, at least two other areal electrodes secured to the second surface of the body in spaced apart relationship to each other and each in overlapping relation with a part of said first electrode to provide at least two parallel electrical conduction paths through the resistance body between said opposite surfaces, said electrodes comprising conductive layers with different areas of overlap between each of said two other electrodes and said first electrode whereby the surface areas of said other electrodes are different, means connecting said first electrode to one terminal of a voltage source, and means for adjusting the temperature level of the device comprising a switching device for selectively connecting one or more of said other electrodes to the other terminal of the voltage source.

6. A heating device as claimed in claim 5 wherein said two other electrodes are spaced apart by a distance that is independent of the thickness of the resistance body, said resistance body is plate-shaped and said first electrode covers the major part of the first surface thereof.

* * * * *

UNITED STATES PATENT AND TRADEMARK OFFICE

CERTIFICATE OF CORRECTION

PATENT NO. : 4,151,401

DATED : April 24, 1979

INVENTOR(S) : ANDRE M.A. VAN BOKESTAL ET AL

It is certified that error appears in the above-identified patent and that said Letters Patent are hereby corrected as shown below:

IN THE TITLE PAGE - IN THE ABSTRACT line 2, "having first" should read --having a first--;

line 3, "electrodes of" should read --electrodes preferably of--.

IN THE CLAIMS

Claim 1, lines 52, 53, "connecting at least said" should read --connecting said--;

Claim 2, lines 61, 62, "claim 1, and wherein" should read --claim 1, wherein--.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*